US012571308B2

(12) United States Patent
Guo et al.

(10) Patent No.: US 12,571,308 B2
(45) Date of Patent: Mar. 10, 2026

(54) METHOD FOR RECOVERING RESIDUAL COAL PILLARS BY FREEZING WATER ACCUMULATED IN ROOM-AND-PILLAR MINING AREA

(71) Applicant: Taiyuan University of Technology, Taiyuan (CN)

(72) Inventors: Jun Guo, Taiyuan (CN); Xiaoze Wen, Taiyuan (CN); Guorui Feng, Taiyuan (CN); Jinwen Bai, Taiyuan (CN); Ruipeng Qian, Taiyuan (CN); Xu Zhang, Taiyuan (CN); Jiahao Zhang, Taiyuan (CN); Quan Liu, Taiyuan (CN); Zilong Zhang, Taiyuan (CN); Xueyao Wu, Taiyuan (CN)

(73) Assignee: Taiyuan University of Technology, Taiyuan City (CN)

( * ) Notice: Subject to any disclaimer, the term of this patent is extended or adjusted under 35 U.S.C. 154(b) by 0 days.

(21) Appl. No.: 19/031,453

(22) Filed: Jan. 18, 2025

(65) Prior Publication Data

US 2025/0163804 A1 May 22, 2025

(30) Foreign Application Priority Data

Jul. 16, 2024 (CN) ..... 202410949466.X

(51) Int. Cl.

| | |
|---|---|
| ***E21D 9/00*** | (2006.01) |
| ***E21C 41/18*** | (2006.01) |
| *E21F 15/00* | (2006.01) |

(52) U.S. Cl.

CPC ..... *E21D 9/001* (2013.01); *E21C 41/18* (2013.01); *E21F 15/00* (2013.01)

(58) Field of Classification Search

CPC ..... E21D 9/001; E21C 41/18; E21F 15/00

See application file for complete search history.

(56) References Cited

FOREIGN PATENT DOCUMENTS

| | | | | |
|---|---|---|---|---|
| CN | 101725352 | A | 6/2010 | |
| CN | 104213921 | A | 12/2014 | |
| CN | 107605484 | A | 1/2018 | |
| CN | 110410076 | A | 11/2019 | |
| CN | 110761791 | A | 2/2020 | |
| CN | 110792471 | A | 2/2020 | |
| CN | 110847954 | A | 2/2020 | |
| CN | 110847955 | A | 2/2020 | |
| CN | 112627817 | A | 4/2021 | |
| CN | 112832769 | A | 5/2021 | |
| WO | WO-2020093813 | A1 * | 5/2021 | ..... E21C 41/18 |
| WO | 2021184694 | A1 | 9/2021 | |

* cited by examiner

*Primary Examiner* — Kyle Armstrong

(57) ABSTRACT

A method for recovery of residual coal pillars by freezing accumulated water in room-and-pillar mining areas is provided. A feasibility of repeated mining of residual coal pillars in room-and-pillar goafs is distinguished based on production data and exploration data of a mine. An accumulated water in the room-and-pillar mining areas is frozen to replace a paste filling material, which envelopes collapse roofs and gangues in the room-and-pillar goaf as a whole. The room-and-pillar goaf is filled with a frozen ice body. Roadways and mining faces are arranged in the frozen ice body. Coal cutter cuts the residual coal pillars and the frozen ice body. With the advancing of the mining face, the residual coal pillars are gradually recovered and melted water after the cutting is pumped out.

10 Claims, 3 Drawing Sheets

METHOD FOR RECOVERING RESIDUAL COAL PILLARS BY FREEZING WATER ACCUMULATED IN ROOM-AND-PILLAR MINING AREA

CROSS-REFERENCE TO RELATED APPLICATIONS

This application claims the benefit of priority from Chinese Patent Application No. 202410949466.X, filed on Jul. 16, 2024. The content of the aforementioned application, including any intervening amendments thereto, is incorporated herein by reference in its entirety.

TECHNICAL FIELD

This application relates to coal mining technology, and more particularly to a method for recovering residual coal pillars by freezing water accumulated in a room-and-pillar mining area.

BACKGROUND

In recent years, the price of international energy has risen sharply, the supply and demand of coal continues to be tight, and the function of coal in energy security is more prominent. The recovery of residual coal caused by the decreasing of high-quality shallow coal resources and backward mining technology has become another important measure to ensure the supply of coal resources after the deep mining. In addition, with the gradual reduction of coal reserves, the contradiction between the unlimited growth of coal demand and the limited nature of non-renewable resources is becoming more and more acute. Improving the recovery rate of resources and building energy-saving mining areas have become an important task for coal mining enterprises to ensure supply.

Limited by history and mining technology level, the average recovery rate of many coal mines in the early stage is not more than 30%, and the recovery rate of some small coal mines is only 10% to 20%. Therefore, in the existing production mine areas and mines, there are many residual coal seams in the destruction of small coal mines. The room mining method with integration of mining and excavation in the early stage arranges a series of 5-7 m coal rooms in the coal seam, 20-30 m coal rooms are arranged between the 5-7 m coal rooms, which forms a narrow working face while mining coal resources in the coal rooms, and generally advancing in groups. Coal pillars between the coal rooms are used as supporting structures of roofs in the process of room-and-pillar type mining. After the coal rooms are mined, the coal pillars are abandoned in large quantities, resulting in a large amount of resource waste. After that, most of room-and-pillar goafs is filled with water, and mechanical properties of residual coal pillars gradually deteriorate. The existing and common methods for repeated mining through solid waste filling (Chinese Patent Publication No. 200910258318.9 developed a method for recovery of room-and-pillar type coal pillars by combined mining of solid filling; Chinese Patent Publication No. 201910756396.5 developed a method for recovery of residual coal pillars by mining with filling in room-and-pillar goafs) need to pumping the water out of the room-and-pillar goafs. After verification of distribution of the residual coal pillars, filling by pumping paste material and repeated mining for recovery of the residual coal pillars are carried out, where costs are high and construction is difficult owing to filling of goafs with large areas. Therefore, it is urgent to find a method that can reasonably solve accumulated water in room-and-pillar goafs, and safely, efficiently and economically recover residual coal pillars in room-and-pillar mining areas.

SUMMARY

In order to solve the above problems, this application provides a method for recovering residual coal pillars by freezing water accumulated in a room-and-pillar mining area, which is mainly aimed at highly efficient recovery of residual coal pillars in room-and-pillar goafs mostly filled with water, and is mainly suitable for the efficient recovery of residual coal pillars by room-and-pillar type mining in the early stage.

On the basis of verification of distribution of coal pillar groups in a room-and-pillar goaf, distribution of room-and-pillar goaf groups, accumulated water quantity in the room-and-pillar goaf and a range of accumulated water, this application uses artificial refrigeration technology to freeze the accumulated water in the room-and-pillar goaf, so that the accumulated water in liquid phase becomes ice with carrying capacity close to a coal sample. The ice becomes a filling body to fill the room-and-pillar goaf, and a whole goaf is filled with huge ice frozen by accumulated the water. At the same time, the huge ice, a top and bottom plate of the residual mining area, the coal pillar and boundary coal pillars of the room-and-pillar goaf form a cooperative carrier to jointly bear a load transmitted from an overlying stratum. A mining roadway and mining face are set in the frozen ice and the residual coal pillar, and then the frozen ice and the residual coal pillars are subjected to synchronous cutting by a coal cutter. With an advance of the mining face, the accumulated water melted in the process of synchronous cutting and ice debris melted in the transportation process after synchronous cutting are extracted, and coal resources of the residual coal pillars are recovered. To achieve the purpose of efficient mining of the residual coal pillars, it is not necessary to deal with a lot of accumulated water at one time, and can solve problems of fire prevention and gas control in coal mining.

This application provides a method for recovering residual coal pillars by freezing accumulated water in a room-and-pillar mining area, comprising:

(S1) performing core drilling and peeping a room-and-pillar goaf, combined with original geologic data and technical data and distribution of a coal pillar group and a goaf group, plotting a distribution pattern diagram of an overlying stratum of the room-and-pillar goaf, residual coal pillars in the room-and-pillar goaf and the room-and-pillar goaf to guide safe production; and determining height, volume and water quality of accumulated water in the room-and-pillar goaf;

(S2) measuring strength and Mohs hardness of a coal sample obtained by the core drilling, and measuring strength and Mohs hardness of an ice body formed from a water sample from the accumulated water in the room-and-pillar goaf;

regarding the room-and-pillar goaf as an intact unmined coal seam, and in combination with mechanical parameters of the coal sample and the ice body, carrying out design of a mining face, equipment selection and roadway design of a mining face for recovery of the residual coal pillars in the room-and-pillar mining area;

(S3) regarding an existing roadway on a same seam in parallel with a direction of the room-and-pillar goaf as a freezing auxiliary roadway; drilling a series of horizontal boreholes on a wall of the freezing auxiliary roadway towards an accumulated water area of the room-and-pillar goaf; arranging a plurality of first freezing pipelines respectively in the series of horizontal boreholes for communication with the accumulated water of the room-and-pillar goaf; and in a case that there is no suitable roadway to choose from the coal seam where the room-and-pillar goaf is located, choosing a roadway in the overlying stratum of the room-and-pillar goaf; drilling a series of vertical boreholes from top to bottom; and arranging the plurality of first freezing pipelines in the series of vertical boreholes in the overlying stratum;

(S4) deploying a freezing workstation in the freezing auxiliary roadway arranged in step (S3); circulating a salt water through the plurality of first freezing pipelines to perform heat exchange with the accumulated water, so as to allow the accumulated water to enter an active freezing period, thereby converting the accumulated water into a frozen ice body with a certain carrying capacity, wherein a temperature range of the frozen ice body in the active freezing period is from −20° C. to −12° C.; based on the characteristics that water changes with a shape of a contained body therein and conversion of water into ice results in expanding volume, freezing the accumulated water to abut against to a roof of the room-and-pillar goaf; regarding the frozen ice body from the accumulated water in the room-and-pillar goaf as a filling body, in which the residual coal pillars in the room-and-pillar goaf and broken rocks are contained, wherein the frozen ice body in the room-and-pillar goaf, roof and floor of the room-and-pillar mining area, the residual coal pillars in the room-and-pillar goaf and boundary coal pillars of the room-and-pillar goaf together form a collaborative carrier to jointly bear a load transmitted from the overlying stratum;

(S5) in a case that the accumulated water is insufficient such that the frozen ice body fails to fully abut against the roof of the room-and-pillar goaf, during a freezing process, additionally injecting water through the series of horizontal boreholes or the series of vertical boreholes drilled in step (S3) to ensure the frozen ice body to fully abut against the roof of the room-and-pillar goaf; and in a case that the room-and-pillar goaf is filled with the accumulated water, considering a volume expansion caused by freezing, partially removing the accumulated water through the series of horizontal boreholes or the series of vertical boreholes drilled in step (S3) to ensure the frozen ice body to just abut against the roof of the room-and-pillar goaf;

(S6) after the accumulated water in the room-and-pillar residual mining area is completely frozen, reducing a cooling power of the freezing workstation to enter a negative freezing period to ensure that the frozen ice body will not defrost, wherein a temperature of the frozen ice body in the negative freezing period is kept at −10° C. to −5° C.;

(S7) digging the frozen ice body to form a transporting roadway and a ventilating roadway therein; melting, by an explosion-proof electric heating bar, the frozen ice body along a central axis of the transporting roadway and the ventilating roadway, and pumping out water formed by melting the frozen ice body; after the transporting roadway and the ventilating roadway reaches a design size, arranging a second freezing pipeline on a surface of an inner wall of each of the transporting roadway and the ventilating roadway to maintain the surface of each of the transporting roadway and the ventilating roadway, so as to avoid melting of the surface of each of the transporting roadway and the ventilating roadway caused by heat radiation generated by air ventilation and equipment transportation and maintain the transporting roadway and the ventilating roadway in a design shape and the design size; transporting and deploying corresponding mining equipment through the transporting roadway and the ventilating roadway; carrying out open-off cut arrangement on a designated position of the mining face, and arranging the mining face; and (S8) in the negative freezing period, regarding the frozen ice body and the residual coal pillars as a whole, and stepwise cutting, by a coal cutter, the frozen ice body and the residual coal pillars from the open-off cut to recover residual coal in a whole coal seam; wherein ice debris formed by cutting of the frozen ice body is transferred, by a scraper conveyor, together with coal blocks formed by cutting; and arranging a water pump and a discharging groove on each of the mining face, the transporting roadway and the ventilating roadway, so as to pump out water formed by melting the ice debris during cutting and transporting.

In an embodiment, a plurality of temperature sensors are placed together with the plurality of first freezing pipelines and evenly arranged in the accumulated water in the room-and-pillar mining area to establish a real-time dynamic monitoring network to monitor a temperature of the accumulated water (or the frozen ice body) in the room-and-pillar goaf in real time.

In an embodiment, in step (S1), width and height of each of the goaf group and the coal pillar group in the room-and-pillar goaf are obtained by searching the geologic and technical data of the mine; a three-dimensional laser scanner is adopted to determine a distribution orientation, size and volume of the goaf group and determine a depth, distribution range and volume of the accumulated water in the room-and-pillar mining area.

In an embodiment, in step (S2), the room-and-pillar mining area is regarded as the intact unmined coal seam for mining design; wherein corresponding mechanical parameters are comprehensively considered based on mechanical parameters of the ice body (a uniaxial compressive strength of the ice body is 3-6 MPa and a Mohs hardness of the ice body is 2.8-4) and the mechanical parameters of the coal sample.

In an embodiment, in step (S3), the existing roadway on the same seam in parallel with the direction of the room-and-pillar goaf is subjected as the freezing auxiliary roadway; the plurality of first freezing pipelines are arranged in the accumulated water in the room-and-pillar goaf through the series of horizontal boreholes or the series of vertical boreholes, wherein the number of each of the series of horizontal boreholes and the series of vertical boreholes is determined by a required cooling capacity, the volume of the accumulated water and a radius of each of the plurality of first freezing pipelines; the plurality of first freezing pipelines is are configured to form a closed line for salt water circulation to replace the heat of the accumulated water, so that the accumulated water is frozen into the frozen ice body.

In an embodiment, in step (S4), a type, power and number of the freezing workstation are determined based on the required cooling capacity calculated by the volume of the room-and-pillar goaf and the volume of the accumulated water in the room-and-pillar goaf in step (S2); a salt water circulation system selects a $CaCl_2$ solution as a refrigerant, and a cooling water circulation system is cooled naturally by digging a pool; after determination of freezing parameters, a trial run of the freezing workstation and the plurality of first freezing pipelines is carried out in a designated position of the freezing auxiliary roadway in the mine; and a formal construction is carried out after a whole system consisting of the freezing workstation and the plurality of first freezing pipelines runs correctly.

In an embodiment, in step (S5), the frozen water has an expanding volume, and the volume of a frozen ice body is 1.1 times that of an original water;

in a case that the accumulated water does not abut against the roof of the room-and-pillar goaf, and a distance between a water level of the accumulated water and the roof of the room-and-pillar goaf accounts for less than 10% of a total height of room-and-pillar goaf, the frozen ice body can fully abut against the roof of the room-and-pillar goaf;

in a case that the accumulated water is less, the frozen ice body cannot abut against the roof of the room-and-pillar goaf; artificial water injection is used to increase an amount of the frozen ice to fill a whole room-and-pillar goaf, which plays a supporting role for the overlying stratum.

In an embodiment, in step (S6), after the accumulated water in the room-and-pillar residual mining area is completely frozen, an uniaxial compressive strength of the frozen ice body in the negative freezing period is 3 MPa-6 MPa; an extension strength of the frozen ice body in the negative freezing period is about ½ of its compressive strength; a compressive strength of the frozen ice body under a side limit of the boundary coal pillars is 5-10 MPa, which is close to a strength of a gangue concrete paste filling material.

In an embodiment, when a width of the mining face is larger than 50 m, and it is difficult to completely freeze the accumulated water in the room-and-pillar goaf by the plurality of first freezing pipelines arranged through the series of horizontal boreholes or the series of vertical boreholes, the frozen ice body with a thickness of 10-20 m can be frozen in the boundary coal pillars of the room-and-pillar goaf; the transporting roadway and the ventilating roadway and the mining face are arranged in the frozen ice body formed in an inner side of the boundary of the room-and-pillar goaf; the transporting roadway is widened and is provided with a digging auxiliary chamber, wherein the digging auxiliary chamber is configured to arrange the freezing workstation; and the transporting roadway has a function of the freezing auxiliary roadway.

In an embodiment, the negative freezing period in step (S6) refers to a phase in which, after the freezing effect of the active freezing period on the accumulated water in the room-and-pillar mining area (a temperature range of the frozen ice body in the active freezing period is from −20° C. to −12° C.), the accumulated water in liquid phase is frozen completely, and a freezing process is basically completed; in the negative freezing period, the frozen ice body only needs to maintain a frozen state to ensure that it will not defrost; a temperature of a circulating salt water increases, and the temperature range of the frozen ice body increases from −10° C. to −5° C., so as to save energy and be economical as far as possible; and the Mohs hardness of the frozen ice body is reduced, which is conducive to cutting by the coal cutter.

In an embodiment, in the stepwise cutting of the frozen ice body and the residual coal pillars in step (S8), the frozen ice body and the residual coal pillars are regarded as a whole while maintaining the negative freezing period, and the coal cutter works under the cover of a hydraulic support, and a roof collapses with mining.

This application has the following beneficial effects.

(1) This application distinguishes a feasibility of repeated mining for the residual coal pillars in the room-and-pillar goaf based on means of production and exploration data of the mine, adopts artificial refrigeration to freeze the accumulated water in the room-and-pillar goaf, so that the accumulated water in the liquid phase is frozen into a solid phase to replace a paste material as the filling material, which envelops a collapsed top plate and gangue in the whole room-and-pillar goaf into the frozen ice body to form the cooperative carrier. The frozen ice body fills a whole room-and-pillar mining area through fully filling. The roadway is dug and the mining face is arranged in the frozen ice body, and then the coal pillar and the frozen ice body are cut together by the coal cutter. With the advancing of the mining face, the residual coal pillars are gradually recovered, and the accumulated water melted after cutting is pumped out to achieve the effect of efficient recovery of the residual coal pillar.

(2) Compared to the traditional method of recovering coal pillar after filling and mining with solid waste paste materials, this application gradually pumps out melted ice debris after cutting during the repeated mining rather than needs to deal with a large amount of accumulated water in the residual mining area before recovering the coal pillar at one time, which creates conditions for orderly and efficient utilization of accumulated water in the room-and-pillar goaf.

(3) The room-and-pillar goaf is filled with the frozen ice body, and the residual coal pillars are recovered under the support of the frozen ice body, which can solve the problem of gas prevention in the repeated mining, provides a low temperature environment to avoid frequent fire accidents during the repeated mining.

Figure 1:
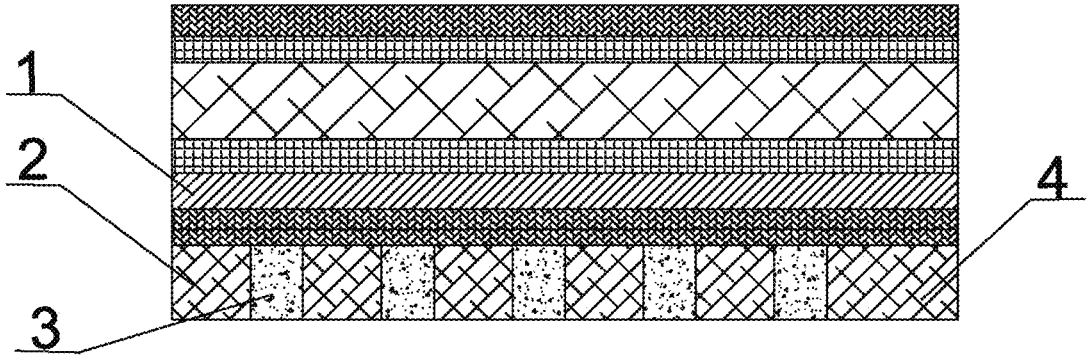
FIG. 1 is a sectional view of an overlying stratum of a room-and-pillar goaf according to an embodiment of the present disclosure.
Figure 2:
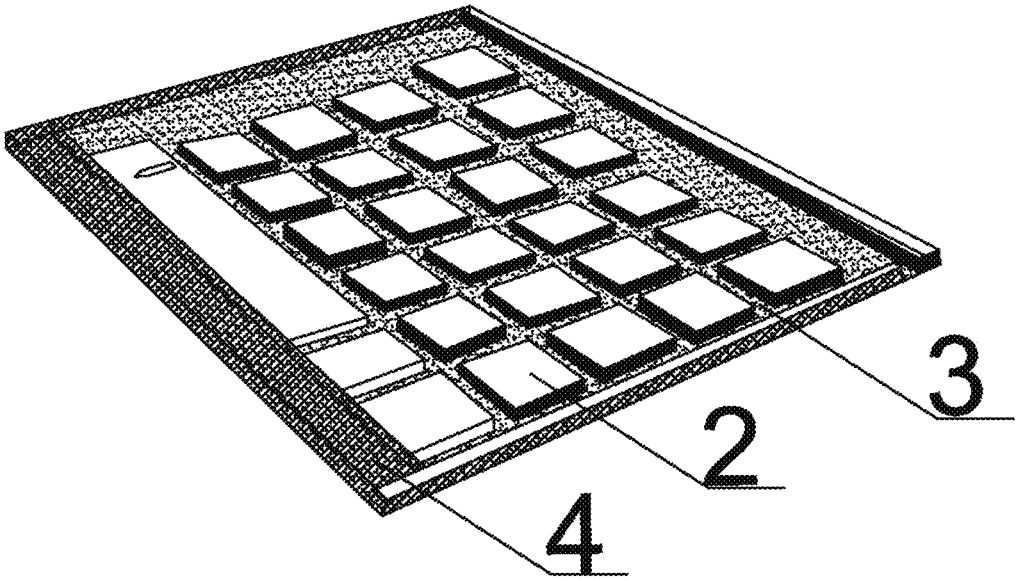
FIG. 2 shows a distribution of a residual coal pillar in the room-and-pillar goaf and the room-and-pillar goaf according to an embodiment of the present disclosure.
Figure 3:
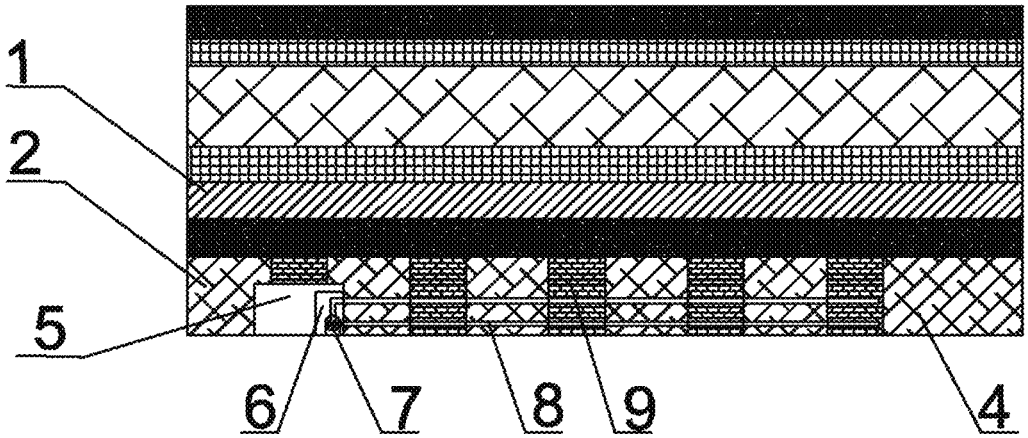
FIG. 3 shows an arrangement of a freezing line and a distribution of a frozen ice body according to an embodiment of the present disclosure.

In Figures: 1, overlying stratum; 2, residual coal pillar; 3, accumulated water; 4, boundary coal pillar; 5, transporting roadway; 6, freezing auxiliary roadway; 7, freezing workstation; 8, first freezing pipeline; and 9, frozen ice body.

DETAILED DESCRIPTION OF EMBODIMENTS

This application is further described by embodiments below, but is not limited to the following embodiments.

To make the understanding of the objects, features and effects of this application more clearly, a method for recovering residual coal pillars by freezing accumulated water in a room-and-pillar mining area will be further described below with reference to the accompanying drawings.

A certain mine is faced with a problem of low recovery rate of resources, so it is urgent to seek new methods to increase recovery rate and extend mine service life. It is a good method to recover residual coal pillars from a No. 2 coal seam which was mined by room-and-pillar mining in an early stage. The No. 2 coal seam has a thickness of 4.2 m, restricted by early backward mining technology, was mined by room-and-pillar mining method. During coal mining, coal pillars with different shapes were left between coal rooms to support top plates, and a recovery rate of coal resources in a whole coal seam was less than 40%. After mining, most areas of a goaf were gradually filled with mine water, which were typical room-and-pillar mining areas with a large amount of high-quality coal. Referring to a traditional paste filling mining method, it is necessary to pump out a large amount of accumulated water in the room-and-pillar goaf at one time, and then to set filling lines for filling, which will increase the cost, therefore, it is urgent to fine a scientific, efficient and economic coal pillar recovery method. In view of the above situation, the embodiments of this application will be further described below with reference to the accompanying drawings, and specific embodiments are described as follows.

(S1) Combined with original geology data and technical data of the mine and distribution of a coal pillar group and a goaf group, a distribution pattern diagram of an overlying stratum 1 of a room-and-pillar goaf, residual coal pillars 2 in the room-and-pillar goaf and the room-and-pillar goaf were plotted to guide safe production. A height of an accumulated water 3 in the room-and-pillar goaf was 4 m, and a volume of the accumulated water 3 accounted for 80% of the room-and-pillar goaf.

(S2) Before a mining design, the residual coal pillars 2 in the room-and-pillar goaf had a uniaxial compressive strength of 10.6 MPa and a Mohs hardness of 1.8-2. The accumulated water 3 in the room-and-pillar goaf was sampled, and a frozen ice body had a uniaxial compressive strength (under a freezing environment from −10° C. to −5° C.) of 3 MPa-6 MPa and a Mohs hardness of 2.8-4. Combining mechanical parameters, such as a compressive strength and Mohs hardness of the coal pillars and mechanical parameters, such as a compressive strength and Mohs hardness of the frozen ice body, a room-and-pillar mining area was regarded as an intact unmined coal seam to carry out design of a mining face, equipment selection and roadway design of a mining face for recovery of the residual coal pillars in the room-and-pillar mining area.

(S3) A mining face of the room-and-pillar goaf was 180 m. Drilling was subjected through an existing roadway on a same seam in parallel with a direction of the room-and-pillar goaf. A plurality of freezing pipelines 8 was arranged to freeze all the accumulated water 3 in the room-and-pillar goaf. Boundary coal pillars of the residual mining area was drilled towards the room-and-pillar goaf, and a part of the accumulated water in the room-and-pillar goaf was frozen in the boundary coal pillars of the residual mining area to form the frozen ice body with a width of 20 m. The accumulated water within a freezing range was frozen, and then a temperature of a circulating salt water increased in a small range, and a temperature of the frozen ice body increases from a range from −12° C. to −20° C. in an active freezing period to a range −5° C. to −10° C.

(S4) The frozen ice body was kept in a negative freezing period, and was dug, and then a transporting roadway 5 was arranged in the frozen ice body. The frozen ice body was stepwise molten by an explosion-proof electric heating bar along a central axis of the transporting roadway, and water formed by melting the frozen ice body was pumped out. The transporting roadway 5 with a designed size was formed by melting the frozen ice body. A second freezing pipeline was arranged on a surface of an inner wall of the transporting roadway 5, so as to maintain the surface of the transporting roadway 5 and avoid melt of the surface of the transporting roadway 5 caused by heat radiation generated by air ventilation and equipment transportation and maintain the transporting roadway in a design shape and the design size.

(S5) The transporting roadway was widened, and a side of the transporting road was provided with a digging auxiliary chamber. The digging auxiliary chamber was configured to arrange a freezing workstation 7. A side of the transporting roadway 5 was configured as a freezing auxiliary roadway 6.

A selection and arrangement of freezing equipment were as follows.

A refrigerating machine adopted a SKD136.1.H type screw chiller unit, where working conditions of individual unit were a cooling capacity of 116960 Kcal/h and a motor power of 114 KW.

Each refrigerating machine was equipped with a salt water circulating pump, where the salt water circulating pump adopted IS150-125-315 type with a single flow rate of 200 $m^3$/h and a motor power of 37 KW.

A cooling water circulating pump of the freezing workstation adopted IS150-125-315B type with a single flow rate of 173 $m^3$/h and a motor power of 18.5 KW.

Each freezing workstation needed to be equipped with additional salt water circulating pump and cooling water circulating pump as alternatives.

Main parameters for freezing construction were as follows:

Refrigerant: freon R-22;

Refrigerating machine oil: Hanzhong HBR-B03 refrigerating machine oil;

Temperature of freezing salt water: active freezing period: from −25° C. to −20° C.; and negative freezing period: from −20° C. to −15° C.;

Average temperature of accumulated water after freezing: from −12° C. to −8° C.; and Delivery pipe of freezing salt water: flexible low-temperature resistant metal pipe.

Specific freezing parameters and details were as follows.

A salt water circulation system selected a $CaCl_2$) solution as a refrigerant. A cooling water circulation system was cooled naturally by digging a pool. After determination of freezing parameters, a trial run of the freezing equipment was carried out, and a formal construction was carried out after a whole system consisting of the freezing workstation and the plurality of first freezing pipelines run correctly.

(S6) A plurality of freezing workstations 7 were arranged in the freezing auxiliary roadway 6 set in step (S5) along a direction of the mining face according to schemes of the freezing construction. The circulating salt water was configured to replace heat of the accumulated water through the freezing line 8 in the accumulated water 3 in the room-and-pillar goaf, so that the accumulated water 3 in the room-and-pillar goaf enter the active freezing period, and water in a liquid phase become ice with a certain carrying capacity, and a temperature range of the frozen ice body was from −12° C. to −20° C. Characteristics that water changes with a shape of a containing body and frozen water has expanding volume were utilized, so that water was frozen and subjected to fully abut against a roof of the room-and-pillar goaf. The frozen ice body 9 frozen from the accumulated water in the room-and-pillar goaf was regarded as filling body, and the residual coal pillars in the room-and-pillar goaf and a broken stone were frozen into the frozen ice body. A whole room-and-pillar goaf was filled with a huge ice frozen by the accumulated water. The frozen ice body 9 in the room-and-pillar goaf, a top and bottom plate of the residual mining area, the residual coal pillars 2 in the room-and-pillar goaf and a boundary coal pillar 4 in the room-and-pillar goaf formed a whole with a certain bearing capacity.

(S7) The volume of the accumulated water 3 accounted for 80% of the room-and-pillar goaf, and a volume of the frozen ice body was 1.1 times that of an original water. When the accumulated water is less, additional water was injected through boreholes formed in step (S3), so as to ensure the frozen ice body 9 in the room-and-pillar goaf to just abut against the roof of the room-and-pillar goaf.

(S8) After the accumulated water in the room-and-pillar residual mining area was completely frozen, a cooling capacity was reduced by the plurality of freezing workstations 7 arranged along the mining face in step (S5) to enter the negative freezing period to ensure the frozen ice body will not defrost, where a temperature of the frozen ice body in the negative freezing period was kept from −10° C. to −5° C.

(S9) In the negative freezing period, the transporting roadway and the ventilating roadway arranged in step (S4) was examined and completed. Corresponding mining equipment were transported and arranged through the transporting roadway and the ventilating roadway, and an open-off cut arrangement was carried out on a designated position of the mining face, and the mining face was arranged.

(S10) In the negative freezing period, the frozen ice body 9 and the residual coal pillars 2 were regarded as a whole, which was gradually cut by a coal cutter from the initial cutting opening to dig and recover the coal in a whole coal seam. With the advance of the mining face, the roof will collapse with mining.

(S11) A part of the frozen ice body was melted during cutting, and ice debris formed by cutting of the frozen ice body was transferred, by a scraper conveyor, together with coal blocks formed by cutting. A water pump and a discharging groove were arranged on each of the mining face, the transporting roadway and the ventilating roadway, so as to pump out water formed by melting the ice debris during cutting and transporting.

What is claimed is:

1. A method for recovering residual coal pillars by freezing accumulated water in a room-and-pillar residual mining area, comprising:

(S1) performing core drilling and peeping the room-and-pillar residual mining area; combined with original geologic data and technical data of a mine and distribution of a coal pillar group and a goaf group, plotting a distribution pattern diagram of an overlying stratum of the room-and-pillar residual mining area, residual coal pillars in the room-and-pillar residual mining area and the room-and-pillar residual mining area to guide safe production; and determining height, volume and water quality of accumulated water in the room-and-pillar residual mining area for subsequent design of freezing the accumulated water in the room-and-pillar residual mining area;

(S2) measuring strength and Mohs hardness of a coal sample obtained by the core drilling from the residual coal pillars in the room-and-pillar residual mining area, and measuring strength and Mohs hardness of an ice body formed from a water sample from the accumulated water in the room-and-pillar residual mining area;

regarding the room-and-pillar residual mining area as an intact unmined coal seam, and in combination with mechanical parameters of the coal sample and the ice body, carrying out design of a mining face, equipment selection, roadway design of the mining face and arrangement of an open-off cut for recovery of the residual coal pillars in the room-and-pillar residual mining area;

(S3) regarding an existing roadway on a same seam in parallel with a direction of the room-and-pillar residual mining area as a freezing auxiliary roadway; deploying a freezing workstation; drilling a series of horizontal boreholes on a wall of the freezing auxiliary roadway towards an accumulated water area of the room-and-pillar residual mining area; arranging a plurality of first freezing pipelines respectively in the series of horizontal boreholes for communication with the accumulated water of the room-and-pillar residual mining area; and in a case that there is no suitable roadway to choose from the coal seam where the room-and-pillar residual mining area is located, choosing a roadway in the overlying stratum of the room-and-pillar residual mining area; drilling a series of vertical boreholes from top to bottom; and placing and arranging the plurality of first freezing pipelines in the series of vertical boreholes in the overlying stratum for communication with the accumulated water of the room-and-pillar residual mining area;

(S4) deploying the freezing workstation in the freezing auxiliary roadway arranged in step (S3); circulating a salt water through the plurality of first freezing pipelines arranged in the accumulated water of the room-and-pillar residual mining area to perform heat exchange with the accumulated water, so as to allow the accumulated water of the room-and-pillar residual mining area to enter an active freezing period, thereby converting the accumulated water in liquid phase into a frozen ice body with a certain carrying capacity, wherein a temperature range of the frozen ice body in the active freezing period is from −20° C. to −12° C.; based on characteristics that water changes with a shape of a contained body therein and conversion of water into ice results in volume expansion, freezing the accumulated water to abut against to a roof of the room-and-pillar residual mining area; regarding the frozen ice body from the accumulated water in the room-and-pillar residual mining area as a filling body, in which the residual coal pillars in the room-and-pillar residual mining area and broken rocks are contained with the accumulated water to form a frozen body, and a whole room-and-pillar residual mining area is filled with the frozen ice body frozen from the accumulated water, wherein the frozen ice body in the room-and-pillar residual mining area, roof and floor of the room-and-pillar residual mining area, the residual coal pillars to be recovered in the room-and-pillar residual mining area and boundary coal pillars of the room-and-pillar residual mining area together form a collaborative carrier to jointly bear a load transmitted from the overlying stratum;

(S5) in a case that the accumulated water frozen in step (S4) is insufficient such that the frozen ice body fails to fully abut against the roof of the room-and-pillar residual mining area, during a freezing process of the accumulated water in step (S4), additionally injecting water through the series of horizontal boreholes or the series of vertical boreholes drilled in step (S3) to ensure the frozen ice body frozen from the accumulated water in the room-and-pillar residual mining area to fully abut against the roof of the room-and-pillar residual mining area; and in a case that the room-and-pillar residual mining area is filled with the accumulated water, considering a volume expansion caused by freezing the accumulated water in step (S4) and the accumulated water is much, partially removing the accumulated water through the series of horizontal boreholes or the series of vertical boreholes drilled in step (S3) to ensure the frozen ice body frozen from the accumulated water in the room-and-pillar residual mining area to just abut against the roof of the room-and-pillar residual mining area;

(S6) after the accumulated water in the room-and-pillar residual mining area is completely frozen, reducing a cooling power of the freezing workstation in step (S4) to enter a negative freezing period to ensure that the frozen ice body will not defrost, wherein a temperature of the frozen ice body in the negative freezing period is kept at −10° C. to −5° C.;

(S7) digging the frozen ice body in the negative freezing period to form a transporting roadway and a ventilating roadway therein; melting, by an explosion-proof electric heating bar, the frozen ice body along a central axis of the transporting roadway and the ventilating roadway, and pumping out water formed by melting the frozen ice body; after the transporting roadway and the ventilating roadway reaches a design size, arranging a second freezing pipeline on a surface of an inner wall of the transporting roadway and the ventilating roadway to maintain the surface of the transporting roadway and the ventilating roadway in a frozen state, so as to avoid melting of the surface of the transporting roadway and the ventilating roadway caused by heat radiation generated by air ventilation and equipment transportation and maintain the transporting roadway and the ventilating roadway in a design shape and the design size; transporting and deploying corresponding mining equipment through the transporting roadway and the ventilating roadway; arranging the open-off cut on a designated position of the mining face, and arranging the mining face; and (S8) in the negative freezing period, regarding the frozen ice body and the residual coal pillars as a whole, and stepwise cutting, by a coal cutter, the frozen ice body and the residual coal pillars from the open-off cut to recover residual coal in a whole coal seam; the frozen ice body is melted during cutting, wherein ice debris formed by cutting of the frozen ice body is transferred, by a scraper conveyor, together with coal blocks formed by cutting; and arranging a water pump and a discharging groove on each of the mining face and the transporting roadway, so as to pump out water formed by melting the ice debris during cutting and transporting.

2. The method of claim 1, wherein a plurality of temperature sensors are placed together with the plurality of first freezing pipelines and evenly arranged in the accumulated water in the room-and-pillar residual mining area to establish a real-time dynamic monitoring network to monitor a temperature of the accumulated water or the frozen ice body in the room-and-pillar residual mining area in real time.

3. The method of claim 1, wherein in step (S1), width and height of each of the goaf group and the coal pillar group in the room-and-pillar residual mining area are obtained by searching the geologic data and technical data of the mine; a three-dimensional laser scanner is adopted to determine a distribution orientation, size and volume of the goaf group in the room-and-pillar residual mining area and determine a depth, distribution range and volume of the accumulated water in the room-and-pillar residual mining area; and in step (S2), the room-and-pillar residual mining area is regarded as the intact unmined coal seam for mining design; wherein corresponding mechanical parameters are comprehensively considered based on mechanical parameters of the ice body and the mechanical parameters of the coal sample; and a uniaxial compressive strength of the ice body is 3-6 MPa and a Mohs hardness of the ice body is 2.8-4.

4. The method of claim 1, wherein in step (S3), the existing roadway on the same seam in parallel with the direction of the room-and-pillar residual mining area is subjected as the freezing auxiliary roadway; the freezing workstation is deployed in the freezing auxiliary roadway, and the plurality of first freezing pipelines are arranged in the accumulated water in the room-and-pillar residual mining area through the series of horizontal boreholes or the series of vertical boreholes on the wall of the freezing auxiliary roadway, wherein the number of each of the series of horizontal boreholes and the series of vertical boreholes is determined by a required cooling capacity, the volume of the accumulated water and a radius of each of the plurality of first freezing pipelines; the plurality of first freezing pipelines are configured to form a closed line in the accumulated water in the room-and-pillar residual mining area for salt water circulation to replace the heat of the accumulated water, so that the accumulated water is frozen into the frozen ice body.

5. The method of claim 4, wherein when a width of the mining face is larger than 50 m, and it is difficult to completely freeze the accumulated water in the room-and-pillar residual mining area by the plurality of first freezing pipelines arranged through the series of horizontal boreholes or the series of vertical boreholes on the wall of the freezing auxiliary roadway in step (S3), the frozen ice body with a thickness of 10-20 m is frozen in the boundary coal pillars of the room-and-pillar residual mining area; the transporting roadway and the ventilating roadway and the mining face are arranged in the frozen ice body formed in an inner side of the boundary coal pillars of the room-and-pillar residual mining area; the transporting roadway is widened and is provided with a digging auxiliary chamber, wherein the digging auxiliary chamber is configured to arrange the freezing workstation; and the transporting roadway has a function of the freezing auxiliary roadway.

6. The method of claim 1, wherein in step (S4), a type, power and number of the freezing workstation are determined based on the required cooling capacity calculated by a volume of the goaf group in the room-and-pillar residual mining area and a volume of accumulated water in the goaf group in the room-and-pillar residual mining area in step (S2); a salt water circulation system selects a $CaCl_2$) solution as a refrigerant, and a cooling water circulation system is cooled naturally by digging a pool; after determination of freezing parameters, a trial run of the freezing workstation and the plurality of first freezing pipelines is carried out in a designated position of the freezing auxiliary roadway in the mine; and a formal construction is carried out after a whole system consisting of the freezing workstation and the plurality of first freezing pipelines runs correctly.

7. The method of claim 1, wherein in step (S5), the frozen water has an expanding volume, and a volume of the frozen ice body is 1.1 times that of an original water;

in a case that the accumulated water does not abut against the roof of the room-and-pillar residual mining area, and a distance between a water level of the accumulated water and the roof of the room-and-pillar residual mining area accounts for less than 10% of a total height of room-and-pillar residual mining area, the frozen ice body can fully abut against the roof of the room-and-pillar residual mining area;

in a case that the accumulated water is less, the frozen ice body cannot abut against the roof of the room-and-pillar residual mining area; artificial water injection is used to increase an amount of the frozen ice body to abut against the roof of the room-and-pillar residual mining area and fill a whole room-and-pillar residual mining area, which plays a supporting role for the overlying stratum on the roof of the room-and-pillar residual mining area.

8. The method of claim 1, wherein in step (S6), after the accumulated water in the room-and-pillar residual mining area is completely frozen, an uniaxial compressive strength of the frozen ice body in the negative freezing period is 3 MPa-6 MPa; an extension strength of the frozen ice body in the negative freezing period is about ½ of its compressive strength; a compressive strength of the frozen ice body under a side limit of the boundary coal pillars of the room-and-pillar residual mining area in the mine is 5-10 MPa.

9. The method of claim 8, wherein the negative freezing period in step (S6) refers to a phase in which, after a freezing effect of the active freezing period on the accumulated water in the room-and-pillar residual mining area, the accumulated water in liquid phase is frozen completely, and a freezing process is basically completed; in the negative freezing period, the frozen ice body only needs to maintain a frozen state to ensure that it will not defrost; a temperature of a circulating salt water increases, and the temperature range of the frozen ice body increases from −10° C. to −5° C.; and the Mohs hardness of the frozen ice body is reduced for the cutting by the coal cutter.

10. The method of claim 1, wherein in the stepwise cutting of the frozen ice body and the residual coal pillars from the open-off cut by the coal cutter in step (S8) to recover the residual coal in the whole coal seam refers that, the frozen ice body and the residual coal pillars are regarded as the intact unmined coal seam while maintaining the negative freezing period, and the coal cutter works under the cover of a hydraulic support, and the roof of the room-and-pillar residual mining area collapses with mining.

* * * * *